US007416338B2

(12) United States Patent
Ausnit

(10) Patent No.: US 7,416,338 B2
(45) Date of Patent: Aug. 26, 2008

(54) RECLOSABLE PACKAGE HAVING ZIPPER WITH HINGED FLAP AND RELATED METHODS OF MANUFACTURE

(75) Inventor: Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 492 days.

(21) Appl. No.: 10/871,194

(22) Filed: Jun. 18, 2004

(65) Prior Publication Data

US 2005/0281491 A1 Dec. 22, 2005

(51) Int. Cl.
*B65D 33/16* (2006.01)

(52) U.S. Cl. ..... 383/64; 383/61.1; 383/61.2; 383/61.3; 24/399; 24/400

(58) Field of Classification Search ..... 383/203, 383/61.1–61.3, 64; 24/399–400, 430
See application file for complete search history.

(56) References Cited

U.S. PATENT DOCUMENTS

| | | | | | |
|---|---|---|---|---|---|
| 3,054,434 | A * | 9/1962 | Ausnit et al. | ..... | 383/65 |
| 3,122,807 | A * | 3/1964 | Ausnit | ..... | 24/399 |
| 3,160,934 | A | 12/1964 | Ausnit | ..... | 24/201 |
| 3,173,184 | A | 3/1965 | Ausnit | ..... | 24/201 |
| 3,220,076 | A | 11/1965 | Ausnit et al. | ..... | 24/201 |
| 3,324,520 | A * | 6/1967 | Ausnit | ..... | 24/399 |
| 3,426,396 | A * | 2/1969 | Laguerre | ..... | 24/427 |
| 3,430,329 | A | 3/1969 | Ausnit | ..... | 29/408 |
| 3,959,856 | A * | 6/1976 | Ausnit | ..... | 24/399 |
| 4,682,366 | A | 7/1987 | Ausnit et al. | ..... | 383/65 |
| 5,351,369 | A * | 10/1994 | Swain | ..... | 24/304 |
| 5,366,294 | A * | 11/1994 | Wirth et al. | ..... | 383/210.1 |
| 5,983,466 | A * | 11/1999 | Petkovsek | ..... | 24/400 |
| 6,247,844 | B1 * | 6/2001 | Tomic et al. | ..... | 383/64 |
| 6,826,808 | B2 * | 12/2004 | Kutschka | ..... | 24/427 |
| 6,948,848 | B2 * | 9/2005 | Ausnit | ..... | 383/64 |
| 7,052,181 | B2 * | 5/2006 | Smith et al. | ..... | 383/64 |
| 2005/0054504 | A1 * | 3/2005 | Haws | ..... | 493/213 |

* cited by examiner

*Primary Examiner*—Nathan J Newhouse
*Assistant Examiner*—Jack H Morgan, Jr.
(74) *Attorney, Agent, or Firm*—Ostrager Chong Flaherty & Broitman P.C.

(57) ABSTRACT

A reclosable package comprises a slider-operated zipper wherein at least one of the zipper parts has a hinged flap to which a marginal portion of a panel of packaging film is joined. The hinged flap swings away from the rest of the zipper part in response to a pulling force tending to pull that zipper part away from the other zipper part. The flap is disposed between a base strip of the zipper part that it forms a part of and a sidewall of the slider. The slider is retained on the zipper by retaining ledges projecting from a distal end of a plow that pries open the zipper during slider travel in an opening direction.

13 Claims, 7 Drawing Sheets

RECLOSABLE PACKAGE HAVING ZIPPER WITH HINGED FLAP AND RELATED METHODS OF MANUFACTURE

BACKGROUND OF THE INVENTION

This invention generally relates to zippers for use in reclosable packaging, such as bags or pouches. In particular, the invention relates to means for providing better resistance to zipper separation due to forces exerted inside the bag.

Reclosable bags are finding ever-growing acceptance as primary packaging, particularly as packaging for foodstuffs such as cereal, fresh vegetables, snacks and the like. Such bags provide the consumer with the ability to readily store, in a closed, if not sealed, package any unused portion of the packaged product even after the package is initially opened.

Reclosable bags typically comprise a receptacle having a mouth with a zipper for opening and closing. In recent years, many zippers have been designed to operate with a slider mounted thereon. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled zipper parts that are joined at opposite ends of the bag mouth. The profiles of interlockable plastic zipper parts can take on various configurations, e.g. interlocking rib and groove elements having so-called male and female profiles, interlocking alternating hook-shaped closure elements, interlocking ball-shaped projections, and so forth. Reclosable bags having slider-operated zippers are generally more desirable to consumers than bags having zippers without sliders because the slider eliminates the need for the consumer to align the interlockable zipper profiles before causing those profiles to engage.

In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

In the past, many interlocking closure strips were formed integrally with the packaging film, for example, by extruding the packaging film with the closure strips formed on the film. Such constructions, however, were limited by the conditions required to extrude both the film and zipper together. To avoid such limitations, many bag designs entail separate extrusion of the closure strips, which are subsequently joined to the bag-making film, for example, by conduction heat sealing. These separate closure strips typically have flanges extending therefrom in such a way that the flanges can be joined to bag-making film in order to attach the closure strips to the film. Many previous slider-operated, separately extruded zippers used flange-type constructions.

An alternative zipper design is the so-called flangeless or string zipper, which has substantially no flange portion above or below the interlockable profiled closure elements. Each zipper part comprises a respective base and a respective profiled closure element or respective set of profiled closure elements projecting from each base. In the case of a string zipper, the bag-making film is joined to the backs of the zipper parts. String zippers can be produced at much greater speeds and in greater multiples, allow much greater footage to be wound on a spool, thereby requiring less set-up time, and use less material than flanged zippers, enabling a substantial reduction in the cost of manufacture and processing.

Under some circumstances, a string zipper has a tendency, however, to be pulled open by forces exerted on the walls of a filled bag during handling. There is a need for a new zipper design having improved resistance to being opened by internally generated forces.

BRIEF DESCRIPTION OF THE INVENTION

The present invention is directed to slider-operated zipper designs having improved resistance to opening due to forces generated internally during handling of the filled package. The invention is also directed to related methods of manufacturing.

One aspect of the invention is a reclosable package comprising a slider-operated zipper attached to a receptacle, the zipper comprising first and second zipper parts, the first zipper part comprising a hinged flap to which a marginal portion of a panel of the receptacle is joined, a portion of the hinged flap swinging away from the rest of the first zipper part in response to a pulling force, exerted by the panel, that tends to pull a portion of the first zipper part away from a corresponding portion of the second zipper part, wherein the flap is disposed between a base strip of the first zipper part and a sidewall of the slider.

Another aspect of the invention is a reclosable package comprising: a first zipper part comprising a first base strip, at least one closure element projecting from the first base strip, a first flap confronting a back of the first base strip, and a first web of material connecting a longitudinal section of the first base strip with a longitudinal section of the first flap, the first web serving as a living hinge that allows the first flap to swing away from the first base strip in response to a pulling force; a second zipper part comprising a second base strip and at least one closure element projecting from the second base strip, wherein the first and second zipper parts are joined at first and second zipper joints disposed at opposite ends thereof, the closure elements of the first and second zipper parts having substantially constant profiles and being mutually interlockable along a section disposed between the first and second zipper joints; a receptacle comprising first and second receptacle walls, a marginal portion of the first receptacle wall being attached to the first flap, and a marginal portion of the second receptacle wall being attached to the second zipper part; and a slider coupled to the first and second zipper parts, causing the first and second zipper parts to interlock when the slider is moved in one direction therealong, and to disengage when the slider is moved in an opposite direction therealong.

A further aspect of the invention is a reclosable package comprising: a first zipper part comprising a first base strip, a first closure element projecting from the first base strip, and a first hinged flap connected to a top portion of the first base strip and confronting a back of the first base strip; a second zipper part comprising a second base strip and a second closure element projecting from the second base strip, wherein the first and second zipper parts are joined at first and second zipper joints disposed at opposite ends thereof, the closure elements of the first and second zipper parts having substantially constant profiles and being mutually interlockable along a section disposed between the first and second zipper joints; a first wall made of packaging film, the first wall having a marginal portion joined to the first hinged flap of the first zipper part; a second wall made of packaging film, the second wall having a marginal portion joined to the second zipper part; and a slider comprising first and second sidewalls, the first and second zipper parts passing through a space between the first and second sidewalls of the slider, the slider causing the first and second zipper parts to interlock when the slider is moved in one direction therealong, and to disengage when the slider is moved in an opposite direction therealong.

Yet another aspect of the invention is a reclosable bag comprising: a receptacle having an interior volume and a mouth, the receptacle comprising first and second panels; a flexible zipper comprising first and second zipper parts respectively joined to the first and second panels in the area of the mouth, the first and second zipper parts being mutually interlockable; and a slider coupled to the zipper, wherein the first zipper part comprises a first base strip, a first profiled closure element projecting from one side of the first base strip, a first flap confronting a back of the first base strip, and a first living hinge that connects a top portion of the first flap to a top portion of the first base strip, the receptacle comprising a first wall having a marginal portion joined to the first flap.

A further aspect of the invention is a method of manufacture, comprising the following steps: (a) extruding a zipper part comprising a base strip, a profiled closure element projecting from one side of the base strip, a flap confronting the other side of the base strip, and a bridge that connects a top portion of the flap to a top portion of the base strip; (b) placing a separator plate between the flap and the base strip; and (c) joining a marginal portion of a web of packaging film to the flap without joining the marginal portion of the web or the flap to the base strip, by pressing the marginal portion of the web and the flap between the separator plate and a heated sealing bar.

Another aspect of the invention is a method of manufacture, comprising the following steps: (a) extruding a zipper part comprising a base strip, a profiled closure element projecting from one side of the base strip, a flap confronting the other side of the base strip, and a bridge that connects a top portion of the flap to a top portion of the base strip; (b) deflecting the flap away from the base strip; (c) coating at least a portion of a back of the base strip or the side of the flap confronting the base strip with non-sealant material; (d) deflecting the flap toward the base strip; and (e) joining a marginal portion of a web of packaging film to the flap without joining the marginal portion of the web or the flap to the base strip.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
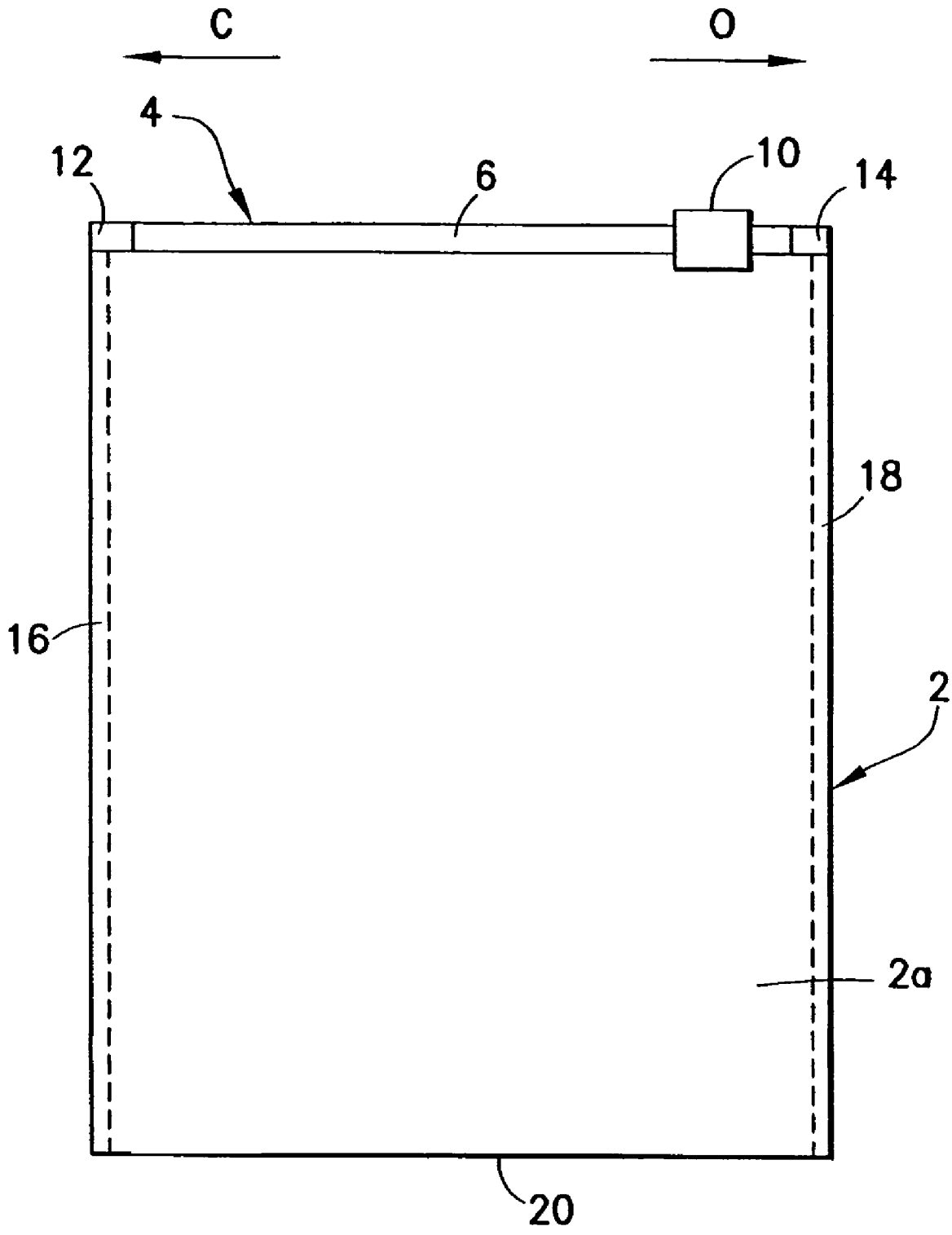
FIG. 1 is a drawing showing a reclosable package having a slider-operated string zipper with end stops.

A reclosable package comprising a bag or receptacle 2 and a flexible plastic zipper 4 operated by manipulation of a slider 10 is shown in FIG. 1. It should be understood that the slider-zipper assemblies disclosed herein can be installed in a reclosable package of the type shown in FIG. 1 or other types of reclosable packages having different structures.

The bag 2 may be made from any suitable film material, including thermoplastic film materials such as low-density polyethylene, substantially linear copolymers of ethylene and a C3-C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. The thickness of the film is preferably 2 mils or less. The bag 2 comprises opposing walls (only the front panel 2*a* is visible in FIG. 1) that may be secured together at opposite side edges of the bag by seams 16 and 18 (indicated by dashed lines). The opposing bottoms of the walls may be joined, for example, by means of a heat seal made in conventional fashion, e.g., by application of heat and pressure. Typically, however, the bottom of the package is formed by a fold 20 in the original packaging film, as depicted in FIG. 1.

At its top end, the bag 2 has an openable mouth, on the inside of which is an extruded plastic zipper 4. The zipper 4 comprises a pair of interlockable zipper parts. One zipper part 6 is visible in FIG. 1. The profiles of the zipper parts may take any form. For example, the zipper may comprise interlocking rib and groove elements, alternating hook-shaped closure elements, or interlocking ball-shaped closure elements. The preferred zipper material is polyethylene. Typically the upper margins of the front and rear bag walls are respectively sealed to the respective zipper parts by conduction heat sealing.

The zipper is operated by sliding the slider 10 along the zipper parts. As the slider moves across the zipper, the zipper is opened or closed. As shown in FIG. 1, the slider is slidable along the zipper in a closing direction "C", causing the zipper parts to become engaged, or in an opening direction "O", causing the zipper parts to become disengaged.

The bag shown in FIG. 1 further comprises end stops 12 and 14 for preventing the slider from sliding off the end of the zipper when the slider reaches the zipper closed or fully opened position. Such end stops perform dual functions, serving as stops to prevent the slider from going off the end of the zipper and also holding the two zipper profiles together to prevent the bag from opening in response to stresses applied to the profiles through normal use of the bag. The end stops typically comprise stomped areas on the zipper parts themselves. The stomped end stops comprise sections of the zipper parts that have been fused together and flattened at the ends of the zipper.

Figure 2:
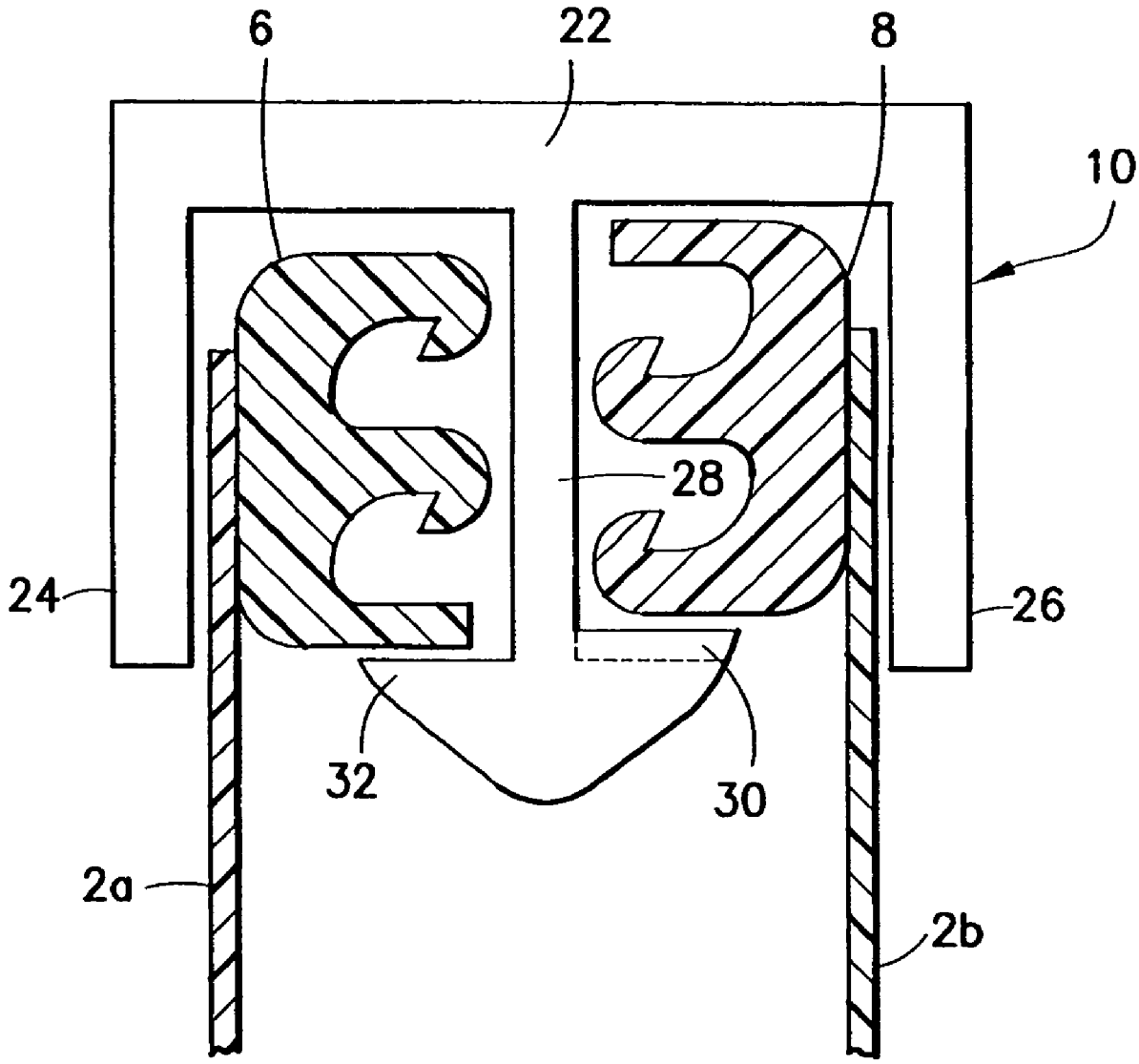
FIG.2 PRIOR ART
FIG. 2 is a drawing showing a partially sectioned view of a slider-string zipper assembly disclosed in U.S. patent application Ser. No. 10/401,365 entitled "Reclosable Packaging Having Slider-Operated String Zipper".

In accordance with a known construction, the zipper 4 shown in FIG. 1 may comprise a string zipper of the type shown in FIG. 2. The string zipper shown in FIG. 2 comprises a pair of mutually interlockable zipper parts 6 and 8. The slider 10 comprises a top wall 22, a pair of side walls 24 and 26 connected to opposing sides of the top wall 22. The top wall 22 and side walls 24, 26 form a tunnel for passage of the string zipper therethrough. The ends of the slider are open to allow the zipper to pass through. The width of the tunnel is substantially constant along the section that is divided by a plow 28 and then narrows from a point proximal to the end of the plow to the closing window at one end face of the slider. FIG. 2 shows the opening end of such a slider. The narrowing section of the tunnel is formed by a pair of substantially planar, inclined interior surfaces (not shown in FIG. 2), which converge toward the closing window of the slider. Each zipper part comprises a respective pair of hooks that interlock with each other when squeezed together by the sidewalls 24 and 26, and that disengage when pried apart by the plow 28.

Still referring to FIG. 2, a pair of retaining ledges 30 and 32 project in opposite directions from the distal end of the plow 28. The upper margins of the bag walls 2*a* and 2*b* are sealed to the backs of the string zipper parts 6 and 8 respectively. The retaining ledges 30 and 32 are parts of a wedge-shaped body formed at the distal end of the plow. The wedge shape facilitates insertion of the slider onto the zipper. Since due to its construction, the bottom of zipper part 8 is positioned above the bottom of zipper part 6, the corresponding retaining ledge 30 may have added material (indicated by dotted lines) to provide greater resistance to the slider being pulled out of the zipper.

As seen in FIG. 2, the upper margins of the bag walls 2*a* and 2*b*, which are joined to the backs of the zipper parts 6 and 8, are disposed between the respective zipper parts and the respective side walls 24 and 26 of the slider. A sealant layer (not shown) may be co-extruded onto the backs of the zipper parts to facilitate sealing of the bag-making film to the zipper parts.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

The present invention seeks to improve upon the performance of reclosable bags having string zippers by adding structure that enables the zipper to remain closed despite forces tending to pull the walls of the bag apart. Such forces may be generated, for example, by the product pressing against the walls of the bag. Certain embodiments of the invention provide the additional advantage of eliminating potential film overhang that can interfere with slider function, as will be explained in more detail later with reference to FIG. 9.

Figure 3:
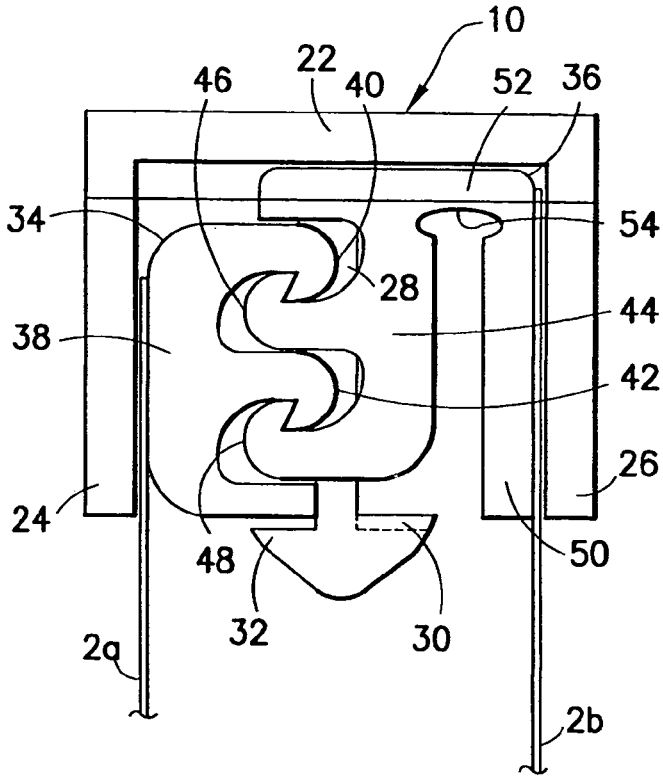
FIG. 3 is a drawing showing a section of a zipper having a slider mounted thereon and joined to respective marginal portions of opposing walls of packaging film in accordance with one embodiment of the invention. Only the closing end of the slider is shown.

In accordance with one embodiment of the invention depicted in FIG. 3, the zipper comprises a flangeless zipper part 34, which may be similar in structure to the string zipper part 6 seen in FIG. 2, and a zipper part 36, which has a portion similar to the string zipper part 8 seen in FIG. 2, but also has a hinged flap incorporated therein. More specifically, zipper part 34 comprises a base strip 38 and a pair of hooks 40, 42 projecting from one side of the base strip 38, while zipper part 36 comprises a base strip 44, a pair of hooks 46, 48 projecting from one side of the base strip 44, a flap 50, and a bridge 52 connecting the top longitudinal portion of the base strip 44 to the top longitudinal portion of the flap 50. The flap extends downward in an elevation direction, but does not extend beyond or extends only slightly beyond the lowermost elevation of the remaining parts of the zipper (i.e., excluding the flap). The zipper parts are joined (not shown in FIG. 3) at opposite ends of the zipper, for example, by ultrasonic stomping of the zipper material. The zipper material at the joints may be deformed into respective shapes that are suitable for acting as slider end stops (not shown).

A marginal portion of one wall 2*a* of the receptacle (only partially shown) is joined to the back of the zipper part 34, while a marginal portion of wall 2*b* is joined to the surface of flap 50 that faces away from the base strip 44. The packaging film making up the walls is typically joined to the zipper parts by conventional conductive heat sealing. The side seals and bottom seal (or fold) of the receptacle are not shown.

The bridge 52 is sufficiently flexible that it acts as a so-called "living hinge", allowing the flap 50 to swing outward (except for the portion of the flap constrained by the abutting sidewall 26 of the slider) and away from the base strip 44. The bridge 52 is partly defined on its interior perimeter by a channel 54 having a curved profile. This channel 54 communicates with the gap between the base strip 44 and flap 50. In the event that wall 2*b* exerts a pulling force on the flap 50, then the flap 50 will swing away from base strip 44 while the hooks remain interlocked, thereby diminishing any tendency for the zipper to open in response to the pulling force.

Although FIG. 3 depicts a gap between the base strip 44 and flap 50, the broad concept of the invention also encompasses the flap abutting against the base strip in an unflexed state.

The slider 10 may be of the type that has a separating finger or plow, such as the plow shown in FIG. 2, wherein a wedge at the distal end of the plow retains the slider on the zipper. If the slider separating finger does not have retaining ledges, then one sidewall of the slider may be provided with a projection or ledge (not shown in FIG. 3) that latches under the base strip 38, while the other sidewall may be provided with a projection or ledge (not shown in FIG. 3) that latches under the end of the flap 50. These projections assist in retaining the slider on the zipper. In either case, no portion of the zipper (including the flap) extends below the lowermost portion of the slider.

Figure 4:
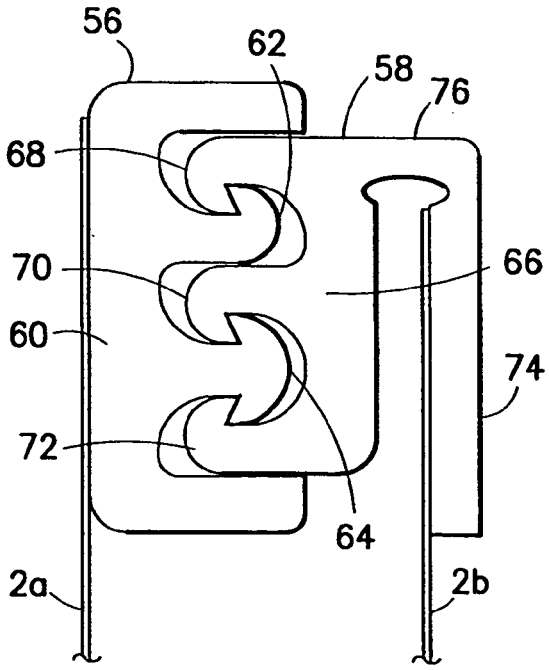
FIG. 4 is a drawing showing a section of a zipper joined to respective marginal portions of opposing walls of packaging film in accordance with another embodiment of the invention.

In accordance with another embodiment of the invention depicted in FIG. 4, the zipper comprises a flangeless zipper part 56 and a zipper part 58 having a hinged flap 74. More specifically, zipper part 56 comprises a base strip 60, and a hook 62 and a double-hooked rib 64 projecting from one side of the base strip 60, while zipper part 58 comprises a base strip 66, three hooks 68, 70, 72 projecting from one side of the base strip 66, a flap 74, and a bridge 76 connecting the top longitudinal portion of the base strip 66 to the top longitudinal portion of the flap 74. Again, the bridge 76 is sufficiently flexible that it acts as a living hinge.

Still referring to FIG. 4, a marginal portion of one wall 2*a* of the receptacle (only partially shown) is joined to the back of the zipper part 56, while a marginal portion of wall 2*b* is joined to the surface of flap 74 that faces toward the base strip 66, i.e., the marginal portion of wall 2*b* is disposed between the flap 74 and the base strip 66. Again, the side seals and bottom seal (or fold) of the receptacle are not shown. In the event that wall 2*b* exerts a pulling force on the flap 74, then again the flap 74 will swing away from base strip 66 while the closure elements, i.e., the rib and hooks, remain interlocked, thereby diminishing any tendency for the zipper to open in response to the pulling force.

The present invention is not limited to any particular shape for the profiled closure elements. While the examples disclosed above show primarily interlocking hooks, other interlocking closure elements, such as elements of the rib-and-groove type or interlocking ball-shaped elements, can be utilized.

Figure 5:
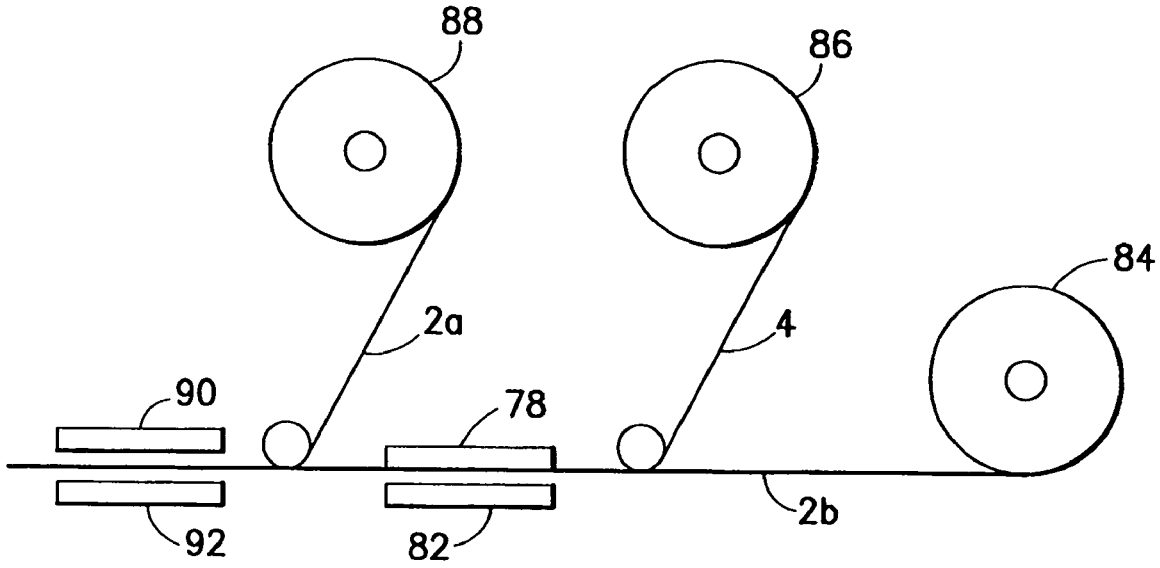
FIG. 5 is a drawing showing one stage in a method for manufacturing reclosable packages having zippers of the type depicted in FIG. 3.
Figure 6:
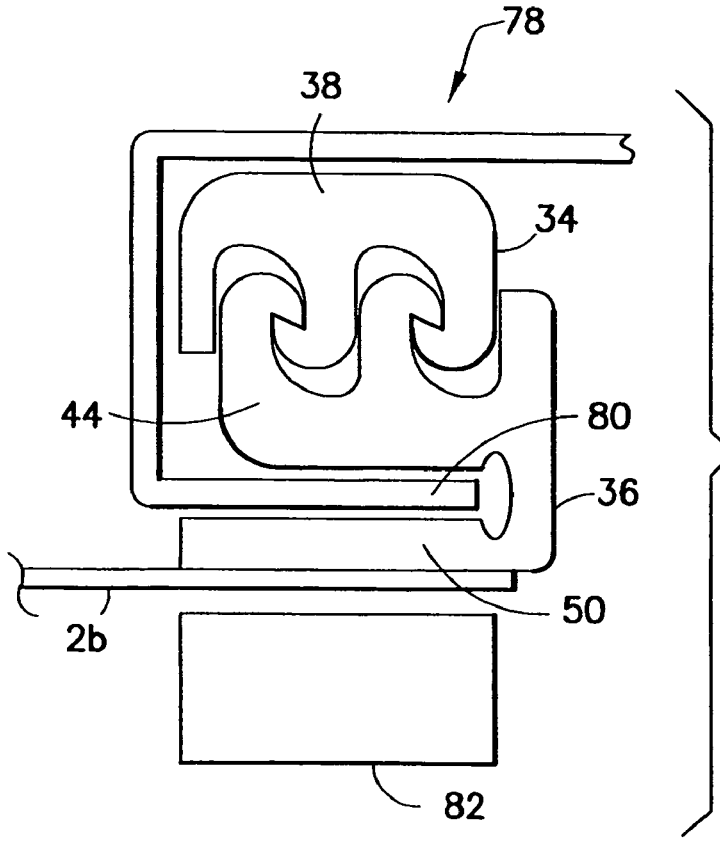
FIG. 6 is a drawing generally representing a system for manufacturing reclosable packages having zippers of the type depicted in FIG. 3.

The present invention also includes methods for attaching the packaging film to a hinged flap without sealing the flap to its confronting base strip. One such method is shown in FIGS. 5 and 6. FIG. 5 shows portions of a machine for making bags of the type shown in FIG. 3. In accordance with one embodiment of the invention, a web 2*b* of film is unwound from a supply roll 84 and then pulled leftward by means of conventional guide and drive rollers (not shown). Optionally, a product loading mechanism (not shown) places a mass of product on top of the web 2*b*. A respective product mass would be placed on the web 2*b* at the same loading point after each package-length advancement of the web.

Further downstream, a continuous length of zipper material 4, comprising a pair of interlocked zipper parts of the type shown in FIG. 3, is unwound from a supply reel 86 and guided on its side to a position overlying a marginal portion proximal and parallel to one edge of the film web 2*b*. A stationary guide 78 guides the zipper into a position in front of heated sealing bar 82 at a first sealing station. This arrangement is shown in detail in FIG. 6.

As seen in FIG. 6, the guide 78 comprises a generally U-shaped channel by which the zipper profiles are guided to advance in a straight line, with the flap of zipper part 36 being disposed outside the channel and in front of the sealing bar 82. More precisely, wall 80 of the guide 78 forms a separator plate that occupies the gap between the base strip 44 of zipper part 36 and the flap 50. This separator plate 80 shields the base strip 44 from the heat emitted by the heated sealing bar 82 during the operation of heat sealing the web 2*b* to the outer surface of the flap 50. During each dwell time, the reciprocatable heated sealing bar 82 is extended by an air cylinder (not shown), causing the heated face of the sealing bar 82 to press the flap 50 against the separator plate 80. As heat and pressure are applied, one or both of the film 2*b* and the surface of flap 50 melt at their interface. The heated sealing bar is then retracted. During subsequent cooling, the film 2*b* and the flap 50 fuse together to form a permanent seal. The separator plate 80 prevents seal-through of the flap 50 to the base strip 44 during the heat sealing operation.

Referring again to FIG. 5, the zipper-film assembly is then advanced to the next stage of the manufacturing process. Another web 2*a* of film is unwound from a supply roll 88 and then pulled leftward by means of conventional guide and drive rollers (not shown). The web 2*a* is laid on top of the web 2*b* with their respective edges generally aligned. During each dwell time, a reciprocatable heated sealing bar 90 is extended by an air cylinder (not shown), causing the heated face of the sealing bar 90 to press the zipper 4 against a stationary unheated sealing bar 92. As heat and pressure are applied, one or both of the film 2*a* and the back of the base strip of the other zipper part (i.e., zipper part 34 shown in FIG. 6) to melt at their interface. The heated sealing bar 90 is then retracted. During subsequent cooling, the film 2*a* and the back of zipper part 34 fuse together to form a permanent seal. If needed, a separator plate (not shown) may be disposed between the zipper parts at this second sealing station to prevent seal-through of the zipper parts.

After each package-length section of zipper has been sealed to both webs, that section is advanced to a slider insertion station (not shown), where one slider is inserted per package-length section. The construction of the slider insertion device will vary depending on whether the slider has a separating finger or not. At a minimum, the slider insertion device will comprise means for securely holding the zipper in proper position and a cylinder-actuated pusher assembly that pushes each slider onto the zipper while it is being held in place. Typically, the portion of the holding means disposed upstream of the slider insertion device are retractable to allow the slider to pass through. If the slider has a separating finger, then means for opening the zipper in the area where the finger is to be inserted are also provided.

During the same dwell time that a slider is being inserted, a slider end stop structure (not shown) is being formed on the zipper at an ultrasonic stomping station (not shown) downstream from the slider insertion device. The conventional ultrasonic stomping station typically comprises a reciprocatable horn and a stationary anvil (neither of which are shown in the drawings). The resulting stomped slider end stop structure will be bisected later during cutting by a hot knife to form two slider end stops, i.e., the end stop at the zipper fully closed slider park position for one package and the end stop at the zipper fully open slider park position for the next package. The horn may transmit sufficient ultrasound wave energy into the plastic zipper material that the plastic is fused into a slider end stop structure (e.g., a vertically extending hump) defined by the surfaces of the horn and anvil.

In addition, during each dwell time a pair of reciprocatable sealing bars (not shown), one or both of which are heated, form cross seals having centerlines spaced at intervals equal to one package length. Thereafter, the hot cutting knife (which may comprise a solitary blade or a pair of opposed blades) cuts the cross-sealed zones, thereby severing a package from the remainder of the zipper-web assembly on the FFS machine. Alternatively, a separate cross sealing operation is not performed and instead, the hot knife cuts and forms side seals in the film on both sides of the cut in one operation.

In accordance with another alternative method of manufacture, a web is unwound from a supply reel and then zipper is unwound and laid along the edge of the unfolded web. The web is then joined to the lower half of the zipper by means of a heated sealing bar at a first sealing station. Then the product is loaded and a portion of the web is folded over the product with the edge of the folded-over portion generally aligned with the other edge of the web. The folded-over portion of the web is then joined to the upper half of the zipper by means of a heated sealing bar at a second sealing station.

Figure 7:
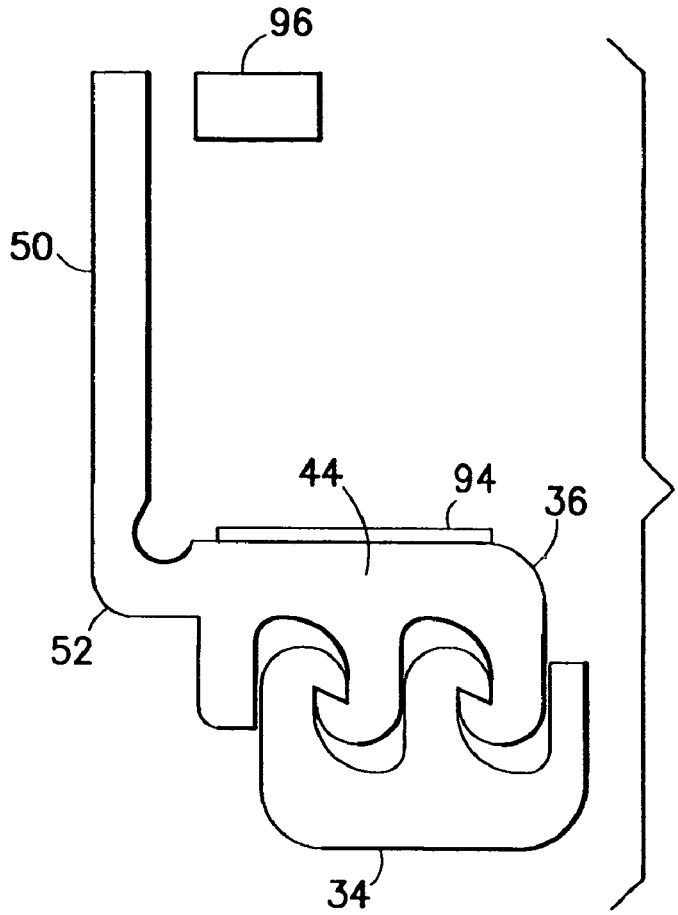
FIG. 7 is a drawing showing one stage in another method for manufacturing a reclosable package having a zipper with a hinged flap.

In accordance with another method of manufacture partly shown in FIG. 7, the flap 50 is pivoted 90 degrees upward by a deflector 96 to expose the back of the base strip 44 of zipper part 36. A layer 94 of non-sealant material is then applied to the exposed surface. [As used herein, the term "layer of non-sealant material" means a layer of material that is interposed between two other layers to prevent those other layers from being sealed to each other. Certain printing inks will provide this feature or the extrusion of a high-density polyethylene layer on a base polyethylene layer, the former having a much higher melting point than the latter, can also be used.] Then the flap 50 is returned to its original (i.e., undeflected) position, e.g., by a further deflector not shown in FIG. 7.T*he* presence of non-sealant layer 94 prevents seal-through of the flap to the base strip when packaging film is later heat sealed to the flap.

Figure 8:
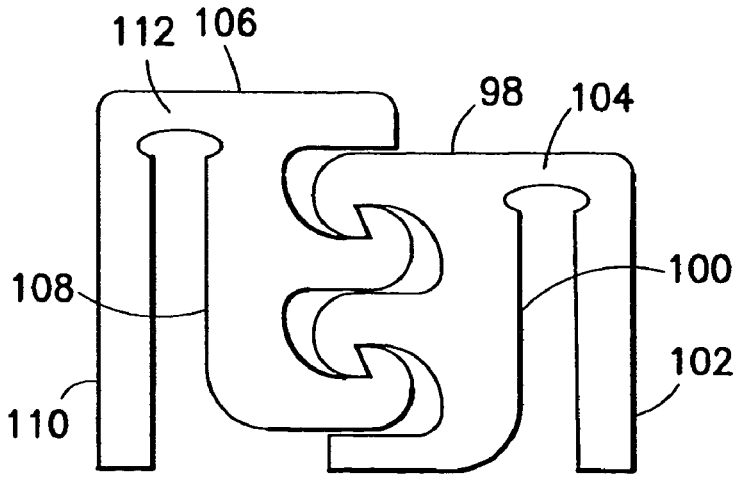
FIG. 8 is a drawing showing the structure of a zipper in accordance with a further embodiment of the invention.

Each of the embodiments shown in FIGS. 3 and 4 has only one flap. However, the invention encompasses embodiments in which both zipper parts are provided with flaps. In these cases, one wall of the receptacle is joined to the flap of one zipper part, while the other wall of the receptacle is joined to the flap of the other zipper part. One embodiment of this type is depicted in FIG. 8. Zipper part 98 comprises a base strip 100 connected to a flap 102 by a bridge 104, while zipper part 106 comprises a base strip 108 connected to a flap 110 by a bridge 112. Marginal portions of the respective bag walls (not shown) in FIG. 8) can be joined to either side of the respective flaps.

Figure 9:
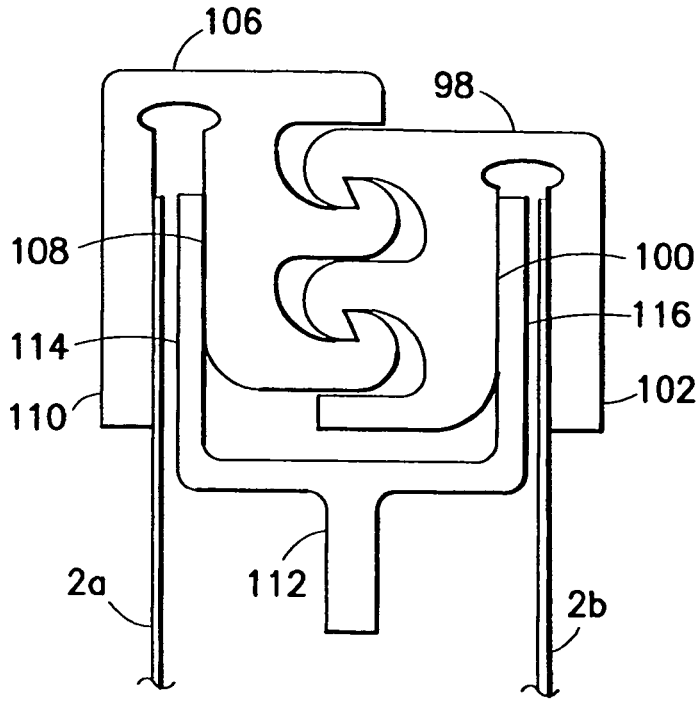
FIG. 9 is a drawing showing one stage in a method for manufacturing reclosable packages having zippers of the type depicted in FIG. 8.
Figure 10:
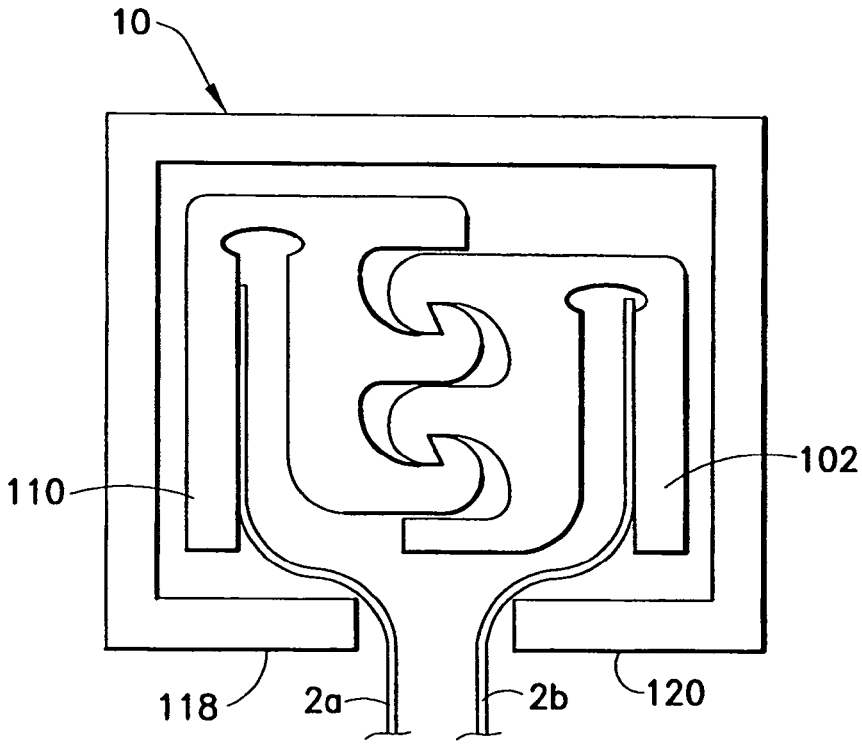
FIG. 10 is a drawing showing the zipper of FIG. 9 with a slider having inwardly facing retaining ledges.

FIG. 9 shows the case wherein wall 2*a* is joined to the interior surface of flap 110, i.e., the surface that confronts the base strip 108 of zipper part 106, while wall 2*b* is joined to the interior surface of flap 102, i.e., the surface that confronts the base strip 100 of zipper part 98. A stationary guide 112 guides the zipper into a position in between a pair of opposing reciprocatable heated sealing bars (not shown in FIG. 9). The guide 112 comprises a generally U-shaped channel by which the zipper profiles are guided to advance in a straight line, with the flaps 102 and 110 of the respective zipper parts being disposed outside the channel. More precisely, wall 114 of the guide 112 forms a separator plate that occupies the gap between the base strip 108 of zipper part 106 and the flap 110, while wall 116 of the guide 112 forms a separator plate that occupies the gap between the base strip 100 of zipper part 98 and the flap 102. These separator plates 114 and 116 shield the respective base strips from the heat emitted by the heated sealing bars during the heat sealing of the webs 2*a* and 2*b* to the respective flaps, thereby preventing seal-through of the flap or web joined thereto to the opposing base strip. The embodiment depicted in FIG. 9 has the advantage of eliminating potential film overhang that can interfere with the slider function were the film sealed to the exterior surfaces of the flaps.

Figure 11:
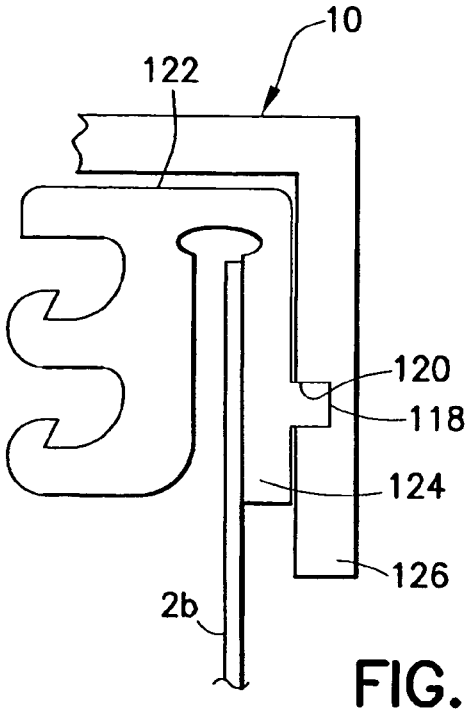
FIG. 11 is a drawing showing a portion of a reclosable package in accordance with yet another embodiment of the invention.

The placement of the bag walls on the insides of the hinged flaps is also advantageous in the case wherein small retaining ribs are formed on the hinged flap. FIG. 11 shows one such retaining rib 118 projecting from the external surface of a flap 124 of a zipper part 122. The rib 118 is straight, has a constant profile along its length, and extends parallel with the longitudinal axis of the zipper (when the zipper is straight). The rib 118 fits in a straight groove 120 formed in a sidewall 126 of a slider 10. While the retaining rib 118 of the embodiment shown in FIG. 11 has a rectilinear profile, the profile instead could be semicircular, trapezoidal or other geometric shape. Although not shown in FIG. 11, the other side of the slider-zipper assembly could have a similar rib/groove arrangement. The outwardly directed ribs on the hinged flap extend a distance approximately equal to the distance between the slider end stops. These ribs both retain the slider on the zipper and provide a dual track for the slider to travel on. The retaining rib and the portion of the bag wall joined to the flap are disposed on opposite sides of the flap. Thus, the slider during its travels would neither cut or tear the bag walls nor damage the permanent film/flap seal.

Figure 12:
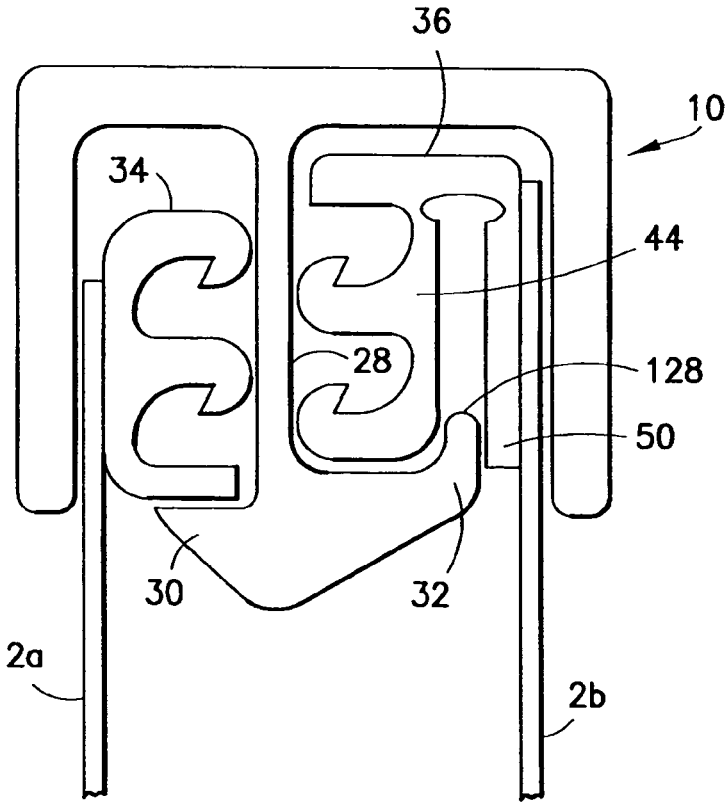
FIG. 12 is a drawing showing a slider construction for use with a zipper of the type shown in FIG. 3 in accordance with a further embodiment of the invention.

In accordance with a further aspect of the invention, the zipper depicted in FIG. 3 could be used with a slider having the construction shown in FIG. 12. Similar to the slider shown in FIG. 2, the slider in FIG. 12 has a pair of retaining ledges 30 and 32 projecting in opposite directions from the distal end of a plow 28, forming a wedge-shaped body that facilitates automated slider insertion. A rib 128 projects upwardly into the gap between a flap 50 and a base strip 44 of the zipper part 36, thereby further preventing the removal of the slider from the zipper.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" includes bags, pouches, and any other type of packaging (filled or empty) in which a flexible plastic zipper can be incorporated. As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc.

The invention claimed is:

1. A reclosable package comprising:

a first zipper part comprising a first base strip, at least one closure element projecting from said first base strip, a first flap confronting a back of said first base strip, and a first web of material connecting a longitudinal section of said first base strip with a longitudinal section of said first flap, said first web serving as a living hinge that allows said first flap to swing away from said first base strip in response to a pulling force;

a second zipper part comprising a second base strip and at least one closure element projecting from said second base strip, wherein said first and second zipper parts are joined at first and second zipper joints disposed at opposite ends thereof, the closure elements of said first and second zipper parts having substantially constant profiles and being mutually interlockable along a section disposed between said first and second zipper joints;

a receptacle comprising first and second receptacle walls, a marginal portion of said first receptacle wall being attached to said first flap, and a marginal portion of said second receptacle wall being attached to said second zipper part; and a slider coupled to said first and second zipper parts and comprising first and second sidewalls, said slider causing said first and second zipper parts to interlock when said slider is moved in one direction therealong and to disengage when said slider is moved in an opposite direction therealong, wherein said first flap is disposed between said first base strip and said first sidewall of said slider, said marginal portion of said first receptacle wall is disposed between said first flap and said first base strip, and said marginal portion of said second receptacle wall is disposed between said second sidewall of said slider and said second zipper part.

2. The reclosable package as recited in claim 1, wherein said second zipper part further comprises a second flap confronting a back of said second base strip, and a second web of material connecting a longitudinal section of said second base strip with a longitudinal section of said second flap, said second web serving as a living hinge that allows said second flap to swing away from said second base strip in response to a pulling force, wherein said marginal portion of said second receptacle wall is attached to said second flap.

3. The reclosable package as recited in claim 1, wherein said marginal portion of said second receptacle wall is joined to a back of said second base strip.

4. The reclosable package as recited in claim 1, wherein said marginal portion of said first receptacle wall is joined to a surface of said first flap that faces toward said back of said first base strip.

5. The reclosable package as recited in claim 1, further comprising a longitudinal rib projecting from a surface of said first flap that faces away from said first base strip, wherein said slider comprises a sidewall having a groove that rides along said rib during slider travel.

6. The reclosable package as recited in claim 1, wherein said slider comprises a plow disposed between opposing sections of said first and second zipper parts, and a retaining latch connected to a distal end of said plow, said retaining latch comprising a projection that latches behind said back of said first base strip.

7. A reclosable package comprising:

a first zipper part comprising a first base strip, a first closure element projecting from said first base strip, and a first hinged flap connected to a top portion of said first base strip and confronting a back of said first base strip;

a second zipper part comprising a second base strip and a second closure element projecting from said second base strip, wherein said first and second zipper parts are joined at first and second zipper joints disposed at opposite ends thereof, the closure elements of said first and second zipper parts having substantially constant profiles and being mutually interlockable along a section disposed between said first and second zipper joints;

a first wall made of packaging film, said first wall having a marginal portion joined to said first hinged flap of said first zipper part;

a second wall made of packaging film, said second wall having a marginal portion joined to said second zipper part; and a slider comprising a top wall and first and second sidewalls connected to and projecting downward from respective sides of said top wall, said first and second zipper parts passing through a space between said first and second sidewalls of said slider, said slider causing said first and second zipper parts to interlock when said slider is moved in one direction therealong, and to disengage when said slider is moved in an opposite direction therealong, wherein said first hinged flap is disposed between said first base strip and said first sidewall of said slider, said marginal portion of said first wall is disposed between said first hinged flap and said first base strip, and said marginal portion of said second wall is disposed between said second sidewall of said slider and said second zipper part.

8. The reclosable package as recited in claim 7, wherein said second zipper part further comprises a second hinged flap connected to a top portion of said second base strip and confronting a back of said second base strip, said marginal portion of said second wall being attached to said second hinged flap.

9. The reclosable package as recited in claim 7, wherein said marginal portion of said first wall is joined to a surface of said first hinged flap that faces toward said back of said first base strip.

10. The reclosable package as recited in claim 7, further comprising a longitudinal rib projecting from a surface of said first hinged flap that faces away said first base strip, wherein said slider comprises a sidewall having a groove that rides along said rib during slider travel.

11. The reclosable package as recited in claim 7, wherein said slider comprises a plow disposed between opposing sections of said first and second zipper parts, and a retaining latch connected to a distal end of said plow, said retaining latch comprising a projection that latches behind said back of said first base strip.

12. A reclosable bag comprising:

a receptacle having an interior volume and a mouth, said receptacle comprising first and second panels;

a flexible zipper comprising first and second zipper parts respectively joined to said first and second panels in the area of said mouth, said first and second zipper parts being mutually interlockable; and a slider coupled to said zipper and comprising first and second sidewalls, wherein said first zipper part comprises a first base strip, a first profiled closure element projecting from a front side of said first base strip, a first flap confronting a back of said first base strip, and a first living hinge that connects a top portion of said first flap to a top portion of said first base strip, said receptacle comprising a first wall having a marginal portion joined to a surface of said first flap that confronts a back side of said first base strip, said first flap being disposed between said first base strip and said first sidewall of said slider.

13. The reclosable package as recited in claim 12, wherein said second zipper part comprises a second base strip, a second profiled closure element projecting from one side of said second base strip, a second flap confronting a back of said second base strip, and a second living hinge that connects a top portion of said second flap to a top portion of said second base strip, said receptacle further comprising a second wall having a marginal portion joined to said second flap, said marginal portion of said second wall being disposed between said second flap and said second sidewall of said slider.

* * * * *